US010443986B2

(12) United States Patent
Nakahashi et al.

(10) Patent No.: US 10,443,986 B2
(45) Date of Patent: Oct. 15, 2019

(54) SMOKE SCREEN GENERATOR

(71) Applicant: DAICEL CORPORATION, Osaka-shi, Osaka (JP)

(72) Inventors: Katsuhiro Nakahashi, Tatsuno (JP); Takao Kuroda, Tatsuno (JP); Atsushi Mimura, Tatsuno (JP); Yuji Higuchi, Tatsuno (JP)

(73) Assignee: DAICEL CORPORATION, Osaka-Shi (JP)

( * ) Notice: Subject to any disclaimer, the term of this patent is extended or adjusted under 35 U.S.C. 154(b) by 0 days.

(21) Appl. No.: 15/759,284

(22) PCT Filed: Oct. 4, 2016

(86) PCT No.: PCT/JP2016/079378
§ 371 (c)(1),
(2) Date: Mar. 12, 2018

(87) PCT Pub. No.: WO2017/068956
PCT Pub. Date: Apr. 27, 2017

(65) Prior Publication Data

US 2018/0252502 A1 Sep. 6, 2018

(30) Foreign Application Priority Data

Oct. 20, 2015 (JP) ..... 2015-206625

(51) Int. Cl.
*F41H 9/06* (2006.01)
*F41B 15/00* (2006.01)
(Continued)

(52) U.S. Cl.
CPC ..... *F41H 9/06* (2013.01); *F41B 15/00* (2013.01); *F42B 12/48* (2013.01); *G08B 15/02* (2013.01)

(58) Field of Classification Search
CPC . F41H 9/06; F41G 15/00; F42B 12/48; G08B 15/02
(Continued)

(56) References Cited

U.S. PATENT DOCUMENTS 1,367,464 A * 2/1921 Cook ..... F42B 12/22 102/430
1,376,316 A * 4/1921 Chilowsky ..... F42B 10/40 102/511
(Continued)

FOREIGN PATENT DOCUMENTS

AU 2003235835 A1 11/2004
JP 3816867 B2 8/2006
(Continued)

OTHER PUBLICATIONS

Extended European Search Report dated Apr. 4, 2019, for European Application No. 16857272.5.

*Primary Examiner* — Michelle Clement
(74) *Attorney, Agent, or Firm* — Birch, Stewart, Kolasch & Birch, LLP

(57) ABSTRACT

The present invention provides a smoke screen generator with a high diffusion rate of a smoke screen.
Ends at both sides of a cylindrical housing are closed by a first closure 20 and a second closure 30 respectively, and a flow path changing member 60 is attached at an interval in an axial direction from the second closure 30. At the time of actuation, a smoke screen source passes through a smoke screen source discharge port 38, first discharge flow paths 44, 45 and 46, and a second discharge flow path 47 and is discharged from a final discharge port 48. Since the smoke screen source is radially discharged from the final discharge port 48, a diffusion rate of a smoke screen increases.

5 Claims, 3 Drawing Sheets

(51) Int. Cl.
*G08B 15/02* (2006.01)
*F42B 12/48* (2006.01)

(58) Field of Classification Search
USPC ..... 102/334
See application file for complete search history.

(56) References Cited

U.S. PATENT DOCUMENTS 2,094,562 A * 9/1937 Lowy ..... F42B 12/20 102/368
2,119,697 A * 6/1938 Anderson ..... F42B 4/26 102/260
2,993,648 A * 7/1961 Blackwell ..... A01M 9/00 102/357
3,109,821 A * 11/1963 York ..... A01M 13/00 102/334
3,110,259 A * 11/1963 Van Dersarl ..... B63B 51/04 102/341
3,143,070 A * 8/1964 Bowen ..... F42B 12/50 102/370
3,324,794 A * 6/1967 Gahle ..... F42B 12/48 102/334
3,345,948 A * 10/1967 Sarvis ..... F42B 10/40 102/513
3,354,829 A * 11/1967 Nichols ..... F41H 9/08 102/334
3,558,285 A * 1/1971 Ciccone et al. ..... C10J 3/00 102/531
3,678,857 A * 7/1972 Evans ..... F42B 12/50 102/368
3,707,918 A * 1/1973 Dunfee ..... F42B 12/50 102/370
3,711,115 A * 1/1973 Lohr ..... B60R 21/2644 102/352
3,730,093 A * 5/1973 Cummings ..... F42B 12/44 102/363
3,904,221 A * 9/1975 Shiki ..... B60R 21/2644 102/531
3,988,888 A * 11/1976 Jacobson ..... F02K 9/32 60/204
4,002,121 A * 1/1977 Prochnow ..... F42B 12/48 102/364
4,186,664 A * 2/1980 Huber ..... F42B 12/48 102/334
4,291,629 A * 9/1981 Kezer ..... F42B 12/48 102/334
4,365,557 A * 12/1982 Couture ..... C10L 11/00 102/341
4,436,036 A * 3/1984 Bell ..... F42B 12/50 102/334
4,454,816 A * 6/1984 Billard ..... F42C 15/184 102/223
4,474,715 A * 10/1984 Weber ..... C06B 33/00 102/288
4,598,096 A * 7/1986 Grant ..... C06D 3/00 102/512
4,622,899 A * 11/1986 Weber ..... C06D 3/00 102/334
4,624,186 A * 11/1986 Widera ..... F42B 4/26 102/334
4,726,295 A * 2/1988 Embury, Jr. ..... F42B 12/70 102/334
4,762,068 A * 8/1988 Lubbers ..... F42B 12/48 102/334
4,805,533 A * 2/1989 Herold ..... F42B 4/26 102/218
4,869,174 A * 9/1989 Hanser ..... C06B 45/20 102/334
4,898,098 A * 2/1990 Frey ..... C06C 9/00 102/334
4,934,272 A * 6/1990 Sternin ..... A23B 4/044 102/334
4,938,144 A * 7/1990 Demarest ..... A01M 1/2066 102/204
5,025,729 A * 6/1991 Cameron ..... F41A 19/58 102/336
5,272,981 A * 12/1993 Badura ..... F42B 5/155 102/334
5,313,888 A * 5/1994 Martin ..... C06B 21/0041 102/205
5,389,308 A * 2/1995 Busel ..... C06B 27/00 102/334
5,499,582 A * 3/1996 Schiessl ..... F42B 4/06 102/285
5,551,345 A * 9/1996 Wardecki ..... F42B 12/48 102/340
5,561,259 A * 10/1996 Herbage ..... F42B 5/08 102/251
5,661,257 A * 8/1997 Nielson ..... F42B 12/48 102/334
5,700,971 A 12/1997 Rayer et al.
5,874,690 A * 2/1999 Brunn ..... F42B 12/48 102/334
5,983,801 A * 11/1999 Brunn ..... F42B 27/00 102/334
6,209,461 B1 * 4/2001 Riffet ..... F42B 12/50 102/334
6,283,032 B1 * 9/2001 Wardecki ..... F42B 12/48 102/315
6,349,650 B1 * 2/2002 Brunn ..... F42B 12/50 102/368
6,414,040 B1 * 7/2002 Van Driel ..... C06D 3/00 102/289
6,523,478 B1 * 2/2003 Gonzalez ..... F42B 12/50 102/216
6,581,521 B1 * 6/2003 Dixon ..... F42B 12/46 102/334
8,714,089 B2 * 5/2014 Prelic ..... F42B 4/26 102/202.14
8,746,737 B2 * 6/2014 Ozaki ..... C06D 5/00 280/741
8,776,691 B2 * 7/2014 Kravel ..... F42B 12/48 102/334
8,776,692 B1 * 7/2014 Fiala ..... F42B 12/48 102/334
10,189,753 B2 * 1/2019 Vandoninck ..... C06D 3/00
2003/0056680 A1 * 3/2003 Santacreu ..... F42B 4/12 102/334
2003/0097950 A1 * 5/2003 Raupp ..... F42B 5/15 102/334
2006/0169163 A1 * 8/2006 Sibum ..... F42B 12/48 102/334
2006/0278409 A1 * 12/2006 Blau ..... A62D 1/06 169/26
2007/0024038 A1 * 2/2007 Numoto ..... B60R 21/2644 280/736
2009/0102171 A1 * 4/2009 Hordos ..... B60R 21/2644 280/741
2009/0152851 A1 * 6/2009 Clark ..... B60R 21/2644 280/741
2010/0199874 A1 * 8/2010 Lubbers ..... F42B 12/36 102/487
2012/0086191 A1 * 4/2012 Parkinson ..... A62C 5/006 280/741
2012/0247359 A1 * 10/2012 Brunn ..... F42B 8/26 102/334
2013/0319278 A1 * 12/2013 Kravel ..... F42B 12/48 102/334
2015/0321970 A1 * 11/2015 Vandoninck ..... A63J 5/025 102/530
2016/0115090 A1 * 4/2016 Moretti ..... C06D 3/00 102/334
2018/0259301 A1 * 9/2018 Mimura ..... C06D 3/00

(56) References Cited

U.S. PATENT DOCUMENTS

FOREIGN PATENT DOCUMENTS

| | | | | |
|---|---|---|---|---|
| JP | 3134430 | U | * | 8/2007 |
| JP | 2015-42603 | A | | 3/2015 |
| JP | 2015-43143 | A | | 3/2015 |
| WO | WO 2004/097760 | A1 | | 11/2004 |

* cited by examiner

[Fig. 1]
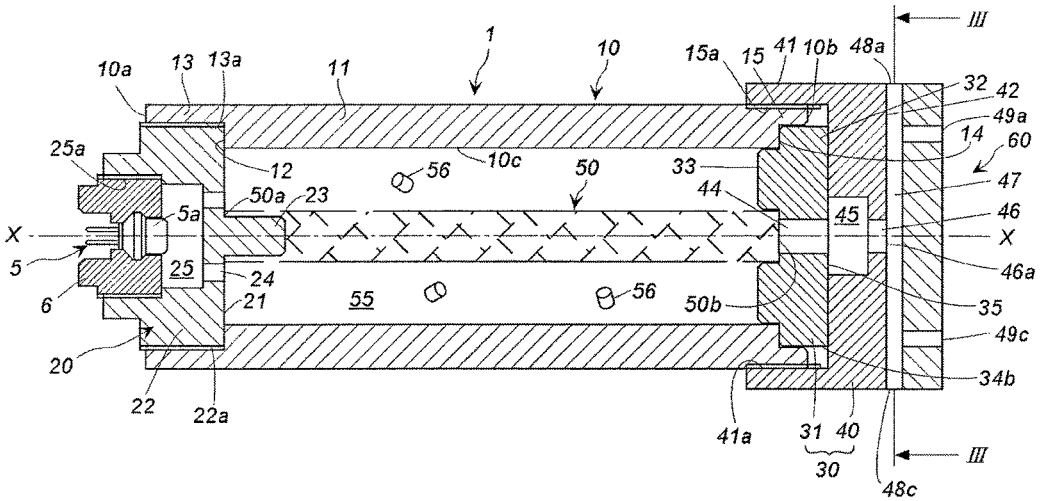
[Fig.2]
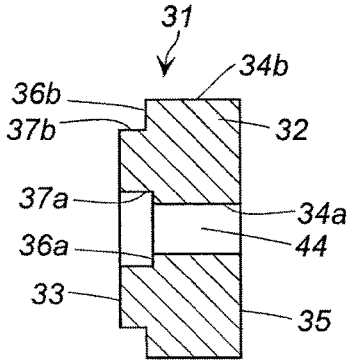

[Fig. 3]
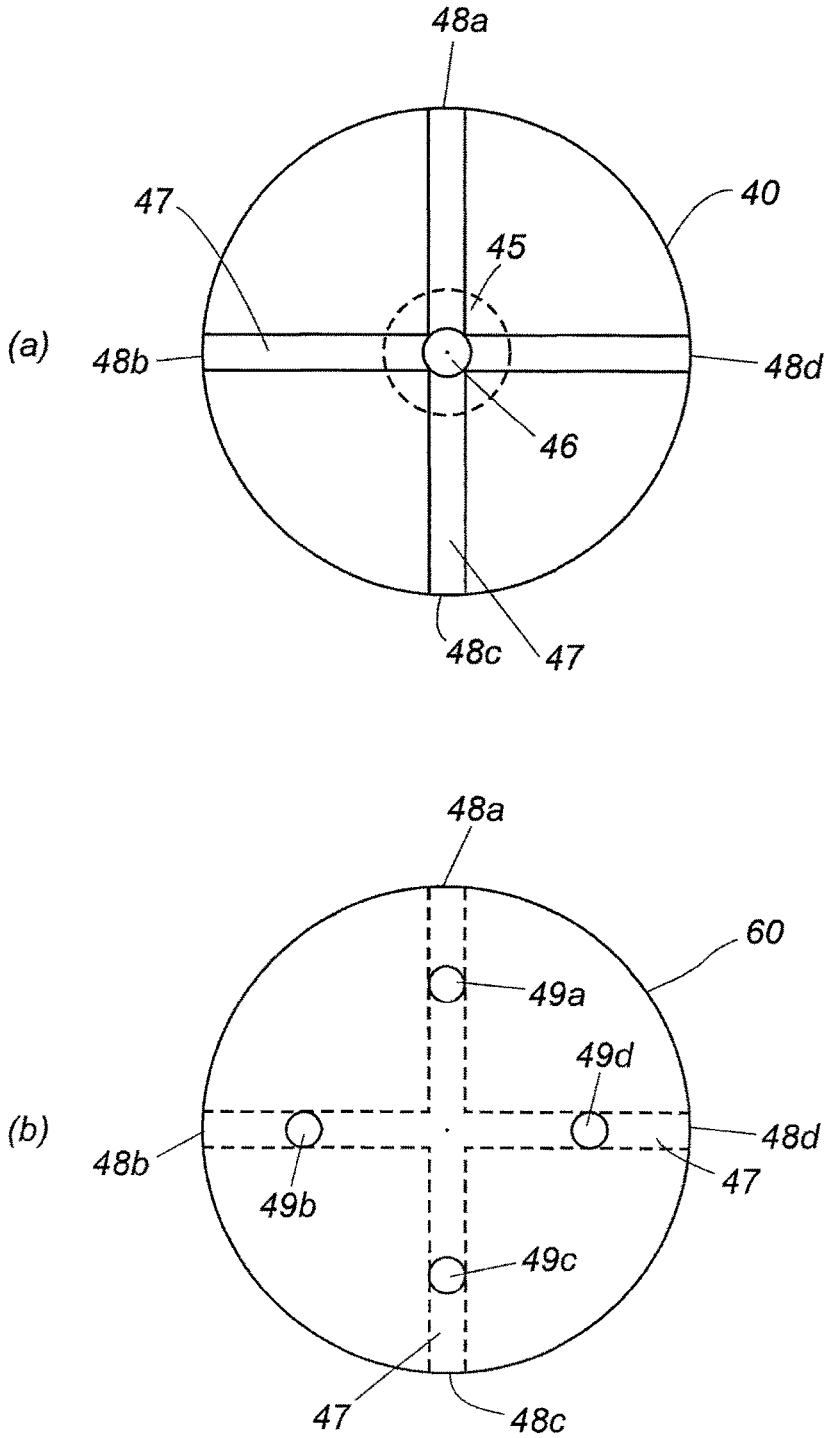

[Fig. 4]
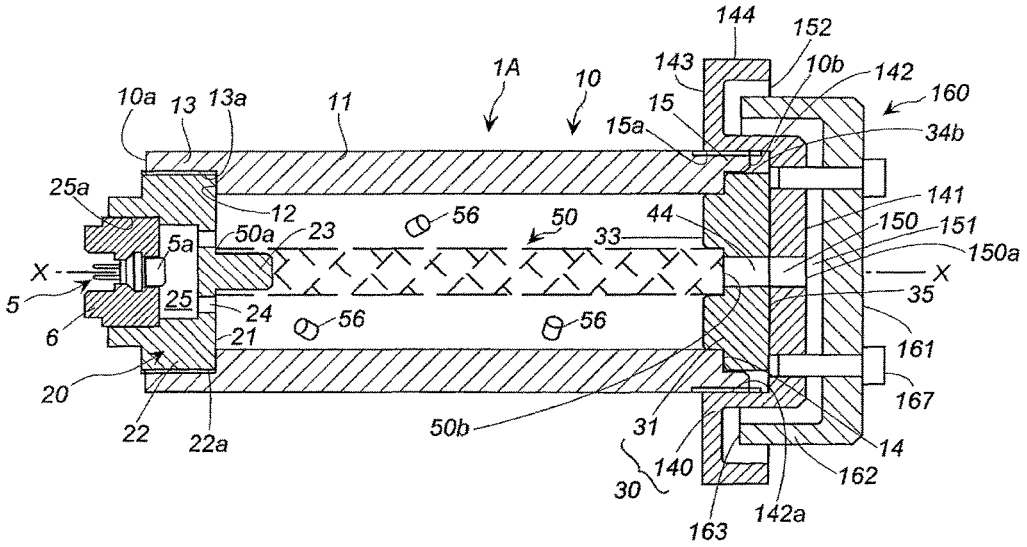

SMOKE SCREEN GENERATOR

TECHNICAL FIELD

The present invention relates to a smoke screen generator which is usable in combination with a security apparatus.

DESCRIPTION OF RELATED ART

A smoke screen generator may be mounted to a ceiling, a wall, or the like of a room in order to mentally confuse an intruder breaking and entering a store, a room, or the like by visually blocking an escape route and to secure time until the intruder is captured.

JP-B No. 3816867 discloses an invention of a smoke screen generation apparatus. As shown in FIGS. 1 to 5, the smoke screen generation apparatus has a disk-like outer shape and, at the time of actuation, discharges a smoke screen in a radial direction.

In the apparatus shown in FIG. 1, when an ignition device 2 is actuated, an ignition agent 5 inside an ignition agent case 4 is ignited and burned, and flames and the like are generated. Subsequently, the flames and the like flow into a combustion chamber 10 to ignite and burn a smoke generating agent 6, and smoke is generated.

JP-A No. 2015-043143 discloses an invention of a smoke generator. As shown in FIGS. 1 and 3, a smoke screen generation apparatus has a disk-like outer shape and, at the time of actuation, discharges a smoke screen in a radial direction in a similar manner to JP-B No. 3816867.

With the smoke generator according to JP-A No. 2015-043143, since a combustion rate of an entire smoke generating agent is improved, an ejection rate and a diffusion rate of generated smoke into a room are also elevated.

SUMMARY OF INVENTION

A first aspect of the present invention (hereinafter, referred to as a "first aspect") provides a smoke screen generator including a cylindrical housing, an igniter and a smoke screen generating agent which are accommodated in the cylindrical housing, a first closure including the igniter and closing a first end opening of the cylindrical housing, a second closure having a first discharge flow path and a first discharge port, which is an outlet of the first discharge flow path, and closing a second end opening of the cylindrical housing on an opposite side in an axial direction to the first end opening, a flow path changing member for a smoke screen source being attached to an outer side of the second closure, a second discharge flow path being provided between the second closure and the flow path changing member and in communication with the outlet of the first discharge flow path, and an outlet of the second discharge flow path being a final discharge port, the first discharge flow path being extended in a direction coaxial with the cylindrical housing and the second discharge flow path being extended in a different direction from that of the first discharge flow path, the first closure having a discharge hole for discharging an ignition product which is generated at the time of actuation of the igniter, a porous cylindrical body being arranged between a surface of the first closure where the discharge hole for the ignition product is not provided and the first discharge flow path of the second closure, a space between an inner circumferential wall surface of the cylindrical housing and the porous cylindrical body being a smoke screen generating agent-accommodating chamber which accommodates the smoke screen generating agent, and the discharge hole for the ignition product facing the smoke screen generating agent-accommodating chamber, and at the time of actuation of the igniter, the smoke screen generating agent in the smoke screen generating agent-accommodating chamber being ignited and burned to generate a smoke screen source, the smoke screen source moving through an inside of the porous cylindrical body, passing through the first discharge flow path, the first discharge port and the second discharge flow path, and thereafter being discharged from the final discharge port to the outside in order to generate a smoke screen.

A second aspect of the present invention (hereinafter, referred to as a "second aspect") provides a smoke screen generator including a cylindrical housing, an igniter and a smoke screen generating agent which are accommodated in the cylindrical housing, a first closure including the igniter and closing a first end opening of the cylindrical housing, a second closure having a first discharge flow path and a first discharge port, which is an outlet of the first discharge flow path, and closing a second end opening of the cylindrical housing on an opposite side in an axial direction to the first end opening, a flow path changing member for a smoke screen source being attached to an outer side of the second closure at an interval from the second closure in the axial direction, the flow path changing member being substaintially in a cup shape and having a bottom portion and a circumferential wall, the second closure having a shape such that a continuous second discharge flow path is formed between the second closure and the bottom portion of the flow path changing member, between the second closure and an inner circumferential surface of the circumferential wall of the flow path changing member, between the second closure and an annular end surface of an opening of the flow path changing member, and between the second closure and an outer circumferential surface of the circumferential wall of the flow path changing member, the first discharge flow path, which is provided in the second closure, being extended in a direction coaxial with the cylindrical housing, the second discharge flow path being provided between the second closure and the flow path changing member and being in communication with the first discharge flow path, extended in an orthogonal direction to the first discharge flow path and further bent at a plurality of locations, and an outlet of the second discharge flow path being a final discharge port, the first closure having a discharge hole for discharging an ignition product which is generated at the time of actuation of the igniter, a porous cylindrical body being arranged between a surface of the first closure where the discharge hole for the ignition product is not provided and the first discharge flow path of the second closure, a space between an inner circumferential wall surface of the cylindrical housing and the porous cylindrical body being a smoke screen generating agent-accommodating chamber which accommodates the smoke screen generating agent, and the discharge hole for the ignition product facing the smoke screen generating agent-accommodating chamber, and at the time of actuation of the igniter, the smoke screen generating agent in the smoke screen generating agent-accommodating chamber being ignited and burned to generate a smoke screen source, the smoke screen source moving through an inside of the porous cylindrical body, passing through the first discharge flow path, the first discharge port and the second discharge flow path, and thereafter being discharged from the final discharge port to the outside in order to generate a smoke screen.

BRIEF DESCRIPTION OF DRAWINGS

The present invention will become more fully understood from the detailed description given hereinbelow and the accompanying drawings which are given by way of illustration only, and thus are no limitative of the present invention and wherein:

FIG. 1 shows a cross-sectional view in an axial direction of a smoke screen generator according to the present invention;

FIG. 2 shows a cross-sectional view of one component shown in FIG. 1;

FIG. 3 shows, in (a), a cross-sectional view with respect to the arrow III-III in FIG. 1 and, in (b), a plan view from a side of a flow path changing member shown in FIG. 1; and FIG. 4 shows a cross-sectional view in an axial direction of another embodiment of a smoke screen generator according to the present invention.

DETAILED DESCRIPTION OF INVENTION

In the apparatus shown in FIG. 1 of JP-B No. 3816867, since the smoke generating agent in the combustion chamber 10 burns in sequence from a position near to the ignition agent case 4 to a position far from the ignition agent case 4, combustion of the entire smoke generating agent 6 takes time, resulting in a slow ejection rate of generated smoke from the apparatus into a room and also a slow diffusion rate of the generated smoke.

The apparatuses according to the inventions of JP-B No. 3816867 and JP-A No. 2015-043143 both have a disk-like outer shape. In other cases, smoke generating apparatuses may have a cylindrical outer shape.

When an apparatus with a cylindrical outer shape is used, it is difficult to increase an ignition and combustion rate of an entire smoke generating agent and further elevate an ejection rate and a diffusion rate of generated smoke into a room.

The present invention provides a smoke screen generator in which an ignition and combustion rate of an entire smoke screen generating agent is increased and, further, an ejection rate and a diffusion rate of generated smoke into a room are elevated with a use of a cylindrical container.

Further, the present invention provides a smoke screen generator which reduces a discharge amount of by-products derived from components of a smoke screen generating agent.

A cylindrical housing is made of a metal such as iron or stainless steel and has a first end opening and a second end opening.

A first closure is made of a metal such as iron or stainless steel and has a shape and a size which are capable of closing the first end opening of the cylindrical housing.

The first closure is attached to the first end opening of the cylindrical housing by being screwed thereinto, by being press-fitted thereinto, or by being welded thereto.

An igniter and the first closure may be integrated or the igniter may be disposed in the first closure.

As the igniter, a known igniter for a gas generator used in an airbag apparatus can be used.

A second closure is made of a metal such as iron or stainless steel and has a shape and a size which are capable of closing the second end opening of the cylindrical housing.

The second closure has a first discharge flow path and a first discharge port for a smoke screen source which is an outlet of the first discharge flow path. The first discharge flow path is extended in a direction coaxial with the cylindrical housing.

The second closure is attached to the second end opening of the cylindrical housing by being screwed thereinto, by being press-fitted thereinto, or by being welded thereto.

The second closure may be formed of a single member or may be formed of a combination of two members.

When the second closure is formed of a combination of two members, the two members may be integrated by being screwed into each other, by being press-fitted into each other, or by being welded to each other.

A porous cylindrical body of the first aspect and the second aspect needs only to be a metallic cylindrical member having a large number of holes on a circumferential surface thereof, and a net molded into a cylindrical shape, a cylinder with a large number of holes formed on a circumferential surface thereof, and the like can be used. However, it is preferable that the porous cylindrical body is a net molded into a cylindrical shape.

Holes of the porous cylindrical body (a mesh size of the net) preferably are in a size such that the smoke screen source passes therethrough and prevents entry of a smoke screen generating agent accommodated in a smoke screen generating agent-accommodating chamber.

Further, when a smoke screen generating agent that is smaller than the holes of the porous cylindrical body (the mesh size of the net) is used as the smoke screen generating agent accommodated in the smoke screen generating agent-accommodating chamber, a combustible member such as paper can be interposed between the porous cylindrical body and the smoke screen generating agent in order to prevent the smoke screen generating agent from entering a discharge path of the smoke screen source.

Prior to actuation, the porous cylindrical body acts to push the smoke screen generating agent accommodated in the smoke screen generating agent-accommodating chamber radially outward and therefore functions to prevent gaps from being created in the smoke screen generating agent-accommodating chamber, and at the time of actuation, the porous cylindrical body functions as a discharge path of the smoke screen source generated by combustion of the smoke screen generating agent.

The smoke screen generating agent is preferably a known smoke screen generating agent molded into a columnar shape or the like, but the smoke screen generating agent may be in a powder form. As the smoke screen generating agent, for example, a smoke generating agent composition including a smoke generating agent and a gas generating agent disclosed in JP-A No. 2015-42603 or a combination of the smoke generating agent and the gas generating agent disclosed in JP-A No. 2015-43143 can be used.

The gas generating agent includes a fuel, an oxidizing agent, a binder and the like. As the fuel, in addition to those described in the above patent documents, a fuel selected from sucrose, silicone oil, and tripotassium citrate salt (monohydrate) can be used.

As the smoke generating agent, a first component, a second component, or a combination of the first component and the second component can be used. The first component is preferably selected from paraffin wax, liquid paraffin, microcrystalline wax, polyethylene glycol and the like, and the second component is preferably selected from metal carbonate (hydrate), metal hydride, and metal hydroxide.

It is preferable in the smoke screen generator according to the present invention that the first discharge flow path which is provided in the second closure is extended in a direction coaxial with the cylindrical housing, and the second discharge flow path between the second closure and the flow path changing member is extended in a direction orthogonal to the first discharge flow path.

The flow path changing member is made of a metal such as iron or stainless steel and is combined with the second closure to form the second discharge flow path.

The flow path changing member and the second closure may be integrated by a fixing means such as a bolt in a state where an interval is provided between the flow path changing member and the second closure. In the case of such a formation, the interval between the flow path changing member and the second closure is the second discharge flow path.

Furthermore, the flow path changing member and the second closure may be formed integrally, or may be integrated by welding. In the case of such formations, for example, the second discharge flow path is formed by a single channel or a plurality of channels (for example, cross-shaped channels or radial channels) connected to an outlet of the first discharge flow path.

The second discharge flow path is extended in a direction that differs from that of the first discharge flow path.

Since the first discharge flow path is extended in the axial direction of the cylindrical housing, an angle formed between the second discharge flow path and the axial direction of the cylindrical housing is preferably equal to or smaller than 90 degrees and may be set to, for example, a range of 45 to 90 degrees.

It is preferable in the smoke screen generator according to the first aspect that the second discharge flow path is provided between the second closure and the flow path changing member, and in communication with an outlet of the first discharge flow path, a through hole, which penetrates the flow path changing member in a thickness direction and reaches the second discharge flow path, is provided, an annular outlet of the second discharge flow path is a first final discharge port and the through hole is a second final discharge port, and the first final discharge port and the second final discharge port are opened and closed to control a discharge direction of a smoke screen source.

The smoke screen generator according to the present embodiment has a first final discharge port and a second final discharge port as final discharge ports connected to the second discharge flow path.

The first final discharge port opens in a direction that differs from the first discharge flow path while the second final discharge port opens in a same direction as the first discharge flow path.

Therefore, by opening or closing the first final discharge port and the second final discharge port, a discharge direction of the smoke screen source is controlled.

A method of opening and closing the first final discharge port and the second final discharge port is not particularly limited and, such a method can be employed that screws are threaded in respective inner wall surfaces of the first final discharge port and the second final discharge port and a bolt is screwed thereinto to close the discharge holes or unscrewed therefrom to open the discharge holes.

Moreover, when there are a plurality of first final discharge ports and a plurality of second final discharge ports, a part of the plurality of the first final discharge ports may be closed while the remaining holes are opened, and a part of the plurality of the second final discharge ports may be closed while the remaining holes are opened.

Since the igniter is positioned at the first end opening together with the first closure, when the igniter is actuated, the smoke screen generating agent in the smoke screen generating agent-accommodating chamber is ignited and burned on the side of the first closure and combustion proceeds toward the second closure.

In the smoke screen generator according to the present invention, the porous cylindrical body is arranged in a central portion of the smoke screen generating agent-accommodating chamber in a range from the first closure to the second closure, and thereby, when the smoke screen generating agent is ignited and burned on the side of the first closure, high-temperature gas generated by the combustion enters the porous cylindrical body, moves in the axial direction, and at the same time, ignites and burns the smoke screen generating agent in contact with the porous cylindrical body.

Therefore, compared to a case where the combustion of the smoke screen generating agent only proceeds from the first closure toward the second closure, overall combustion proceeds more quickly and ejection and diffusion of a smoke screen are also promoted.

Subsequently, after being discharged from a smoke screen source discharge port of the second closure, the high temperature-smoke screen source passes through the first discharge flow path, then changes its direction by passing through the second discharge flow path of the flow path changing member, and is discharged as a smoke screen into a room from the final discharge ports.

In the smoke screen generator according to the first aspect, it is possible that the first discharge flow path which is provided in the second closure is extended in a direction coaxial with the cylindrical housing, and the second discharge flow path between the second closure and the flow path changing member is extended in a direction orthogonal to the first discharge flow path.

With the first discharge flow path and the second discharge flow path being orthogonal to each other, when the smoke screen source enters the second discharge flow path from the first discharge flow path, the smoke screen source collides directly with an inner wall surface to change its direction before being discharged into a room.

In the smoke screen generator according to the second aspect, by adjusting an external shape of the second closure and an internal shape of the flow path changing member, the second discharge flow path is formed to be in communication with the first discharge flow path, and to be extended in an orthogonal direction to the first discharge flow path and further bent at a plurality of locations.

Therefore, the smoke screen source collides at a plurality of locations in the course of passing through the second discharge flow path until the final discharge port, and thereafter is discharged from the final discharge ports.

It is preferable in the smoke screen generator according to the present invention (the first aspect and the second aspect) that a central portion of the first closure, where the discharge holes of the ignition product are not provided, has a protruding portion, a surface of the second closure at a position, which faces the protruding portion of the first closure in the axial direction, has a first discharge flow path, and one end opening of the porous cylindrical body is fitted onto an outer side of the protruding portion of the first closure and the other end opening thereof is fitted to an inner side of the first discharge flow path of the second closure to fix the porous cylindrical body.

In this manner, by fitting and fixing the porous cylindrical body between the protruding portion of the first closure and an annular stepped surface (a depressed portion) of the second closure, the porous cylindrical body is disposed easily.

Since the smoke screen generator according to the present invention provides a high ignition and combustion rate of a smoke screen generating agent and enables a smoke screen to be readily diffused, the smoke screen generator according to the present invention is suitable as a security apparatus.

The smoke screen generator according to the present invention can be used as a security apparatus.

EMBODIMENTS OF INVENTION

<Smoke Screen Generator Shown in FIG. 1>

In a smoke screen generator 1, a cylindrical housing 10 is combined with a flow path changing member 60.

A first annular stepped surface 12 is provided on an inner circumferential surface of a circumferential wall 11 on the side of a first end 10*a* of the cylindrical housing 10, and a section between the first annular stepped surface 12 and the first end 10*a* corresponds to a first tip circumferential wall 13 which is reduced in thickness. An inner circumferential surface 13*a* of the first tip circumferential wall 13 has a screw portion.

A second annular stepped surface 14 is provided on the inner circumferential surface of the circumferential wall 11 on the side of a second end 10*b* of the cylindrical housing 10, and a section between the second annular stepped surface 14 and the second end 10*b* corresponds to a second tip circumferential wall 15 which is reduced in thickness. An outer circumferential surface 15*a* of the second tip circumferential wall 15 has a screw portion.

The first end 10*a* of the cylindrical housing 10 is closed by a first closure 20.

The first closure 20 is substantially in a cup shape and has a bottom surface 21 and a circumferential wall 22.

The bottom surface 21 has a protrusion 23 in a central portion thereof and has, around the protrusion 23, a plurality of discharge holes 24 for an ignition product formed by piercing the bottom surface 21. Around two to eight of the discharge holes 24 for the ignition product are formed at equal intervals in a circumferential direction.

A seal tape which is to rupture during actuation is attached to close the discharge holes 24 of the bottom surface 21, when necessary, in order to prevent spillage of a smoke screen generating agent or as a measure against humidity.

The circumferential wall 22 has a screw portion 22*a* which is screwed into the screw portion of the inner circumferential surface 13*a* of the first tip circumferential wall 13.

An igniter 5 including an igniter collar 6 is disposed in an internal space 25 of the first closure 20.

The igniter 5 is mounted by screwing the igniter collar 6 into an inner circumferential wall surface 25*a* of the first closure 20.

An ignition portion 5*a* of the igniter 5 is positioned inside the internal space 25.

The second end 10*b* of the cylindrical housing 10 is closed by a second closure 30.

The second closure 30 is formed of a combination of a first member 31 and a second member 40, but the second closure 30 may be formed of a single member.

As shown in FIGS. 1 and 2, the first member 31 has an annular substrate 32 with a larger outer diameter, an annular protrusion 33 which is formed on the annular substrate 32 and has an outer diameter smaller than that of the annular substrate 32, an inner circumferential wall 34*a* of the annular substrate, an outer circumferential wall 34*b* of the annular substrate, and an annular bottom surface 35.

Due to a difference in outer diameters between the annular protrusion 33 and the annular substrate 32, the annular protrusion 33 has an annular inner stepped surface 36*a* which is arranged on the side of the inner circumferential wall 34*a* of the annular substrate and faces in the direction of the axis X, and an annular outer stepped surface 36*b* which is arranged on the side of the outer circumferential wall 34*b* of the annular substrate and faces in the direction of the axis X.

Due to a difference in outer diameters between the annular protrusion 33 and the annular substrate 32, the annular protrusion 33 has an annular inner circumferential wall surface 37*a* which faces inward in a radial direction (a direction orthogonal to the direction of the axis X), and an annular outer circumferential wall surface 37*b* which faces outward in the radial direction.

A first-a discharge flow path 44 is formed in a central portion of the first member 31.

The first member 31 is fitted into an opening of the second end 10*b* of the cylindrical housing 10 in a state where the annular outer circumferential wall surface 37*b* abuts against the inner circumferential wall surface 10*c* of the cylindrical housing 10, the annular outer stepped surface 36*b* abuts against the second annular stepped surface 14, and the outer circumferential wall 34*b* of the annular substrate abuts against the second tip circumferential wall 15.

The second member 40 is substantially in a cup-shape and has a circumferential wall 41 and has a bottom surface 42.

The circumferential wall 41 has a screw portion 41*a* on an inner circumferential surface thereof.

The bottom surface 42 has, in a central portion thereof, a first-b discharge flow path 45 and a first-c discharge flow path 46 which are through holes with different inner diameters, and the first-b discharge flow path 45 is connected to the first-a discharge flow path 44.

The first-a discharge flow path 44, the first-b discharge flow path 45, and the first-c discharge flow path 46 form a first discharge flow path for a smoke screen source, and an outlet of the first-c discharge flow path 46 is a first discharge port 46*a*.

The first-a discharge flow path 44 of the first member 31 and the first-b discharge flow path 45 and the first-c discharge flow path 46 of the second member 40 form the first discharge flow path, and centers of the discharge flow paths are positioned coaxially with the axis X of the cylindrical housing 10.

The second member 40 is fixed by screwing the screw portion 41*a* onto the outer circumferential surface 15*a* of the second tip circumferential wall 15.

Since the bottom surface 42 of the second member 40 presses the annular bottom surface 35 of the first member 31 in the direction of the axis X (a direction toward the first end 10*a*), the first member 31 is held between the second member 40 and the second annular stepped surface 14 and fixed thereby.

The flow path changing member 60 is in a disk shape and integrally formed with the second member 40.

As shown in (a) in FIG. 3, a cross-shaped second discharge flow path 47 is formed between the flow path changing member 60 and the second member 40.

A central axis (the axis X) passing through the first-a discharge flow path 44, the first-b discharge flow path 45 and the first-c discharge flow path 46 and a central axis passing through the cross-shaped second discharge flow path 47 are orthogonal to each other.

The cross-shaped second discharge flow path 47 has first final discharge ports 48*a* to 48*d* at four locations.

As shown in (b) in FIG. 3, the flow path changing member 60 has holes 49*a* to 49*d* at four locations in a thickness direction, and the holes 49*a* to 49*d* penetrate from the bottom surface 42 to the cross-shaped second discharge flow path 47 and respectively serve as second final discharge ports 49*a* to 49*d*.

It is possible to close and open every one of the first final discharge ports 48*a* to 48*d* and the second final discharge ports 49*a* to 49*d*.

As a means for closing and opening these ports, a combination of screw portions, which are formed on inner wall surfaces of the first final discharge ports 48*a* to 48*d* and inner wall surfaces of the second final discharge ports 49*a* to 49*d*, and bolts can be used.

Depending on a mounted state of the smoke screen generator, it is possible to control which ones of the first final discharge ports 48*a* to 48*d* and the second final discharge ports 49*a* to 49*d* are opened.

An example thereabove can include an embodiment in which the first final discharge ports 48*a* to 48*d* are opened and the second final discharge ports 49*a* to 49*d* are closed (or an embodiment in which all of the final discharge ports are opened) when the smoke screen generator is installed in a central portion of a ceiling of a room, and an embodiment in which the first final discharge ports 48*a* to 48*d* are closed and the second final discharge ports 49*a* to 49*d* are opened when the smoke screen generator is installed in a corner of the room.

A porous cylindrical body 50 which is formed of a net molded in a cylindrical shape is disposed inside the cylindrical housing 10.

In the porous cylindrical body 50, a first opening 50*a* is fitted onto the protrusion 23 of the first closure 20 from the outer side, and a second opening 50*b* is abutted against the annular inner stepped surface 36*a* and the annular inner circumferential wall surface 37*a* of the first member 31 of the second closure.

Since the porous cylindrical body 50 is fixed from both sides in the direction of the axis X, the porous cylindrical body 50 does not move prior to actuation and at the time of actuation.

A cylindrical space between the inner circumferential wall surface 10*c* of the cylindrical housing 10 and the porous cylindrical body 50 is a smoke screen generating agent-accommodating chamber 55 which accommodates a smoke screen generating agent 56.

The smoke screen generating agent 56 is a known smoke screen generating agent, and a smoke generating agent composition including a smoke generating agent and a gas generating agent disclosed in JP-A No. 2015-42603 or a combination of a smoke generating agent and a gas generating agent disclosed in JP-A No. 2015-43143, or the like can be used.

The smoke screen generating agent 56 can be provided in an agent form with a desired shape such as a columnar shape, a disk shape, a powder shape, and a granular shape.

The smoke screen generating agent-accommodating chamber 55 faces, on the side of the first end 10*a*, the plurality of the discharge holes 24 for the ignition product which are formed on the bottom surface 21 of the first closure 20, and, on the side of the second end 10*b*, the first member 31 of the second closure 30.

The igniter 5, the porous cylindrical body 50, the first-a discharge flow path 44, the first-b discharge flow path 45, the first-c discharge flow path 46 and the flow path changing member 60 are arranged such that central axes thereof and the axis X of the cylindrical housing 10 are coaxial with each other.

An embodiment of a method for assembling the smoke screen generator 1 shown in FIG. 1 will be described, but the assembling method is not limited thereto.

In a state where the first member 31 is arranged at the opening of the second end 10 of the cylindrical housing 10, the second member 40 (the second member 40 integrated with the flow path changing member 60) is screwed onto the cylindrical housing 10 from the outside to be fixed, and thereby, the opening of the second end 10*b* is closed.

Next, in a state where the second opening 50*b* of the porous cylindrical body 50 is fitted into the annular inner stepped surface 36*a* of the first member 31, a prescribed amount of the smoke screen generating agent 56 is charged into the smoke screen generating agent-accommodating chamber 55.

Subsequently, while the first closure 20 is screwed into the first tip circumferential wall 13 of the cylindrical housing 10, the protrusion 23 is fitted into the first opening 50*a* of the porous cylindrical body 50.

Next, the igniter 5 is screwed into the first closure 20 to be fixed.

Next, an operation of the smoke screen generator 1 will be described with reference to FIG. 1.

When the igniter 5 is actuated and an ignition product such as flames is discharged into the internal space 25, the ignition product is discharged into the smoke screen generating agent-accommodating chamber 55 from the discharge holes 24 for the ignition product and the smoke screen generating agent 56 is ignited and burned.

A high-temperature smoke screen source generated by the combustion of the smoke screen generating agent 56 passes through the porous cylindrical body 50 and moves in a direction toward the second closure 30 from the first closure 20.

The combustion of the smoke screen generating agent 56 proceeds in the direction toward the second closure 30 from the first closure 20. At the same time, since ignition and combustion also proceed as the high-temperature smoke screen source, which is passing through the porous cylindrical body 50, comes into contact with the smoke screen generating agent 56, the combustion also proceeds outward from the inside in a radial direction.

Since the combustion of the smoke screen generating agent 56 proceeds in different directions in this manner, even when the cylindrical housing 10 (the smoke screen generating agent-accommodating chamber 55) in an elongated shape as shown in FIG. 1 is used, a rate in which the combustion of the smoke screen generating agent 56 proceeds increases.

After moving through the porous cylindrical body 50, the smoke screen source passes through the first-a discharge flow path 44 of the first member 31, and after further passing through the first-b discharge flow path 45 and the first-c discharge flow path 46 (the first discharge port 46*a*) of the second member 40, collides with the flow path changing member 60, changes its direction, passes through the second discharge flow path 47, and is radially discharged into a room through the first final discharge ports 48*a* to 48*d* to create a smoke screen.

While a discharge rate of the smoke screen source is controlled at a portion with a smallest sectional area in the first discharge flow path (the first-a discharge flow path 44, the first-b discharge flow path 45 and the first-c discharge flow path 46) and the second discharge flow path 47, diffusion of a smoke screen is facilitated by increasing opening areas of the first final discharge ports 48*a* to 48*d* and by causing the smoke screen source to be radially discharged.

Moreover, this operation represents an embodiment in which the second final discharge ports 49*a* to 49*d* are closed. When the first final discharge ports 48*a* to 48*d* are closed and the second final discharge ports 49*a* to 49*d* are opened, since the smoke screen source is discharged in the axial direction, a directional discharge operation of the smoke screen source is realized.

The smoke screen generator 1 shown in FIG. 1 also produces the following collateral effects.

As described above, a combination of a gas generating agent and a smoke generating agent is used as the smoke screen generating agent 56 used in the smoke screen generator 1.

When the smoke screen generating agent 56 burns at the time of actuation, a by-product derived from a component of the smoke screen generating agent 56 may be created concurrently with the generation of a smoke screen source.

Conceivable examples of the by-product include potassium nitrate used as an oxidizing agent, potassium carbonate generated by combustion of sucrose or wax, potassium bicarbonate resulting from the absorption of carbon dioxide by potassium carbonate, carbides derived from an organic substance such as sucrose and waxes, and aggregates including potassium bicarbonate and the carbide.

The by-product hardly contributes to the generation of a smoke screen when discharged into a room from the smoke screen generator 1, and increases a burden of subsequent cleanup work by remaining in the room after actuation in a state where the by-product is adhered to a floor surface or a wall surface of the room.

By using the smoke screen generator 1 shown in FIG. 1, the smoke screen source passes through the first discharge flow path (the first-a discharge flow path 44, the first-b discharge flow path 45 and the first-c discharge flow path 46), collides with the flow path changing member 60 and changes its direction, passes through the second discharge flow path 47, and is discharged into a room through the final discharge ports 48. Accordingly, the smoke screen source (including the by-product described above) in a high temperature state repetitively comes into contact with the inner wall surfaces of the discharge flow paths.

As described above, the smoke screen source (including the by-product described above) in a high temperature state repetitively comes in contact with the inner wall surfaces of the discharge flow paths, and, during this process, the by-product adheres to and is captured by the inner wall surfaces before the smoke screen source is discharged from the final discharge ports 48. Thereby, a discharge amount of the by-product from the final discharge ports 48 is reduced.

<Smoke Screen Generator Shown in FIG. 4>

A smoke screen generator 1A shown in FIG. 4 is the same as the smoke screen generator 1 shown in FIG. 1 with the exception of having a different formation of a second discharge flow path. A same reference numeral as in FIG. 1 refers to a same component or part.

The second closure 30 includes the first member 31 and a second member 140.

The second member 140 is substantially in a cup shape, has a bottom surface 141 and a first circumferential surface 142, further a flange portion 143 extended outward from an opening and a second circumferential surface 144 extended in the direction of the bottom surface 141 from the flange portion 143.

The bottom surface 141 has a through hole in a central portion thereof, the through hole is a first-b discharge flow path 150, and the first-b discharge flow path 150 is connected to the first-a discharge flow path 44.

Further, a seal tape can be provided as necessary before the first-b discharge flow path 150 as a measure against humidity.

An outlet of the first-b discharge flow path 150 which faces a second discharge flow path 151 is a first discharge port 150*a*.

An inner surface of the first circumferential surface 142 has a screw portion 142*a*, and the screw portion 142*a* is screwed onto a screw portion of the outer circumferential surface 15*a* of the second tip circumferential wall 15.

A flow path changing member 160 is in a cup shape and has a bottom surface 161, a circumferential surface 162 and further an annular end surface 163 at an opening.

An inner diameter of the circumferential surface 162 is larger than an outer diameter of the first circumferential surface 142 of the second member 140, and an outer diameter of the circumferential surface 162 is smaller than an inner diameter of the second circumferential surface 144.

The flow path changing member 160 is attachably and detachably mounted to the second member 140 by four bolts 167 such that a continuous interval is formed between the bottom surface 161 and the bottom surface 141 of the second member 140, between an inner circumferential surface of the circumferential surface 162 and an outer circumferential surface of the first circumferential surface 142 of the second member 140, between the annular end surface 163 and the flange portion 143, and between an outer circumferential surface of the circumferential surface 162 and an inner circumferential surface of the second circumferential surface 144.

The four bolts 167 are screwed in so as to straddle through holes at four locations in a thickness direction of the flow path changing member 160 and screw holes at four locations of the second member 140.

The continuous interval between the flow path changing member 160 and the second member 140 is the second discharge flow path 151.

The second discharge flow path 151 is connected to the first discharge flow path (the first-a discharge flow path 44 and the first-b discharge flow path 150) and reaches a final discharge port 152 which is an annular opening, after passing three corner portions (flow paths bent at 90-degree angles).

The smoke screen generator 1A shown in FIG. 4 can be assembled by a similar procedure to the smoke screen generator 1 shown in FIG. 1.

While the smoke screen generator 1A shown in FIG. 4 performs similar operations to the smoke screen generator 1 shown in FIG. 1, since the second discharge flow path 151 is bent, a capturing effect of the by-product described earlier is enhanced as compared to the smoke screen generator 1 shown in FIG. 1.

In the smoke screen generator 1 shown in FIG. 1 and the smoke screen generator 1A shown in FIG. 4, when the following agent is used as a smoke screen generating agent, a reduction effect of a discharge amount of the by-product described earlier is enhanced.

As the smoke screen generating agent, a combination of a gas generating agent and a smoke generating agent is preferably used.

The gas generating agent includes a fuel, an oxidizing agent, a binder which are known, and the like.

The fuel is preferably selected from sucrose, silicone oil, and tripotassium citrate salt (monohydrate).

The oxidizing agent is preferably selected from a chlorate such as potassium chlorate and sodium chlorate, a perchlorate such as strontium perchlorate, magnesium perchlorate, ammonium perchlorate, potassium perchlorate, and sodium perchlorate, and a nitrate such as strontium nitrate, potassium nitrate, and sodium nitrate. Among these, a nitrate is more preferable, and potassium nitrate is even more preferable.

As the smoke generating agent, a first component, a second component, or a combination of the first component and the second component is used.

The first component is preferably selected from paraffin wax, liquid paraffin, microcrystalline wax, polyethylene glycol and the like.

The second component is preferably selected from metal carbonate (hydrate), metal hydride and metal hydroxide.

Experimental Example

The smoke screen generator (with only the first final discharge ports 48*a* to 48*d* opened) shown in FIG. 1, the smoke screen generator shown in FIG. 4, and a comparative smoke screen generator produced by removing the flow path changing member from the smoke screen generator shown in FIG. 1 were prepared.

An actuation experiment was conducted using a smoke screen generating agent with the following composition as the smoke screen generating agents of the respective smoke screen generators, and discharge amounts of by-products were observed.

(Composition of Smoke Screen Generating Agent)

Sucrose/potassium nitrate/paraffin wax=33/52/15 (mass %)

<Observation Method of Discharge Amount of by-Products>

The smoke screen generator was placed at center inside an airtightly sealed test dome (16 $m^3$), and a single sheet of white A3 paper was placed 1 m away from the smoke screen generator.

After actuation of the smoke screen generator, a stain condition of the A3 paper was observed by the naked eye to determine an amount of by-products.

The A3 paper of the comparative smoke screen generator (without the flow path changing member) was colored brown as a whole as compared to a brand new sheet of A3 paper.

The A3 paper of the smoke screen generator shown in FIG. 1 was colored light brown as a whole as compared to a brand new sheet of A3 paper but had less coloration than the comparative smoke screen generator.

The A3 paper of the smoke screen generator shown in FIG. 4 had almost the same color as a brand new sheet of A3 paper.

Moreover, when checked by the naked eye through an observation port of the test dome, there was no obvious difference in thickness of the smoke screen among the smoke screen generators.

Although the staining substance on the sheets of A3 paper is conceivably by-products derived from components of the smoke screen generating agent, if a thickness of a smoke screen due to actuation of the smoke screen generators is the same, a smoke screen generator with a smaller discharge amount of the staining substance is desirable from the perspective of reducing a burden of cleanup work of a room interior after actuation.

Such a variation in the discharge amount of the staining substance is conceivably due to a difference in states of contact (states of collision) between the smoke screen source and the second discharge flow path.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A smoke screen generator, comprising:

a cylindrical housing;

an igniter;

a smoke screen generating agent that generates a smoke screen source when ignited by the igniter, the smoke screen generating agent being accommodated in the cylindrical housing;

a first closure accommodating the igniter and closing a first end opening of the cylindrical housing;

a second closure having a first discharge flow path and a first discharge port, the first discharge port being an outlet of the first discharge flow path, and the second closure closing a second end opening of the cylindrical housing on an opposite side in an axial direction to the first end opening;

a flow path changing member attached to an outer side of the second closure, the flow path changing member changing a flow direction of the smoke screen source;

a second discharge flow path being provided between the second closure and the flow path changing member and in communication with the outlet of the first discharge flow path, and an outlet of the second discharge flow path being a final discharge port;

the first discharge flow path being extended in a direction coaxial with the cylindrical housing and the second discharge flow path being extended in a different direction from that of the first discharge flow path;

the first closure having a discharge hole for discharging an ignition product which is generated at the time of actuation of the igniter;

a porous cylindrical body being arranged between a surface of the first closure where the discharge hole for the ignition product is not provided and the first discharge flow path of the second closure, the porous body having a circumferential surface extending in a longitudinal direction and the circumferential surface defining a plurality of openings;

a space between an inner circumferential wall surface of the cylindrical housing and the porous cylindrical body being a smoke screen generating agent-accommodating chamber which accommodates the smoke screen generating agent, and the discharge hole for the ignition product facing the smoke screen generating agent-accommodating chamber; and at the time of actuation of the igniter, the smoke screen generating agent in the smoke screen generating agent-accommodating chamber being ignited and burned to generate the smoke screen source, the smoke screen source passing through the plurality of openings and moving through an inside of the porous cylindrical body, passing through the first discharge flow path, the first discharge port and the second discharge flow path, and thereafter being discharged from the final discharge port to the outside in order to generate a smoke screen, wherein the second discharge flow path is provided between the second closure and the flow path changing member, and in communication with an outlet of the first discharge flow path, a through hole, which penetrates the flow path changing member in a thickness direction and reaches the second discharge flow path, is provided, an outlet of the second discharge flow path defined by a circumferential surface of the second closure and a circumferential surface of the flow path changing member is a first final discharge port and the through hole is a second final discharge port, and the first final discharge port and the second final discharge port are opened and closed to control a discharge direction of a smoke screen source.

2. The smoke screen generator according to claim 1, wherein the second discharge flow path between the second closure and the flow path changing member is extended in a direction orthogonal to the first discharge flow path.

3. A smoke screen generator, comprising:

a cylindrical housing;

an igniter;

a smoke screen generating agent that generates a smoke screen source when ignited by the igniter, the smoke screen generating agent being accommodated in the cylindrical housing;

a first closure accommodating the igniter and closing a first end opening of the cylindrical housing;

a second closure having a first discharge flow path and a first discharge port, the first discharge port being an outlet of the first discharge flow path, and the second closure closing a second end opening of the cylindrical housing on an opposite side in an axial direction to the first end opening;

a flow path changing member attached to an outer side of the second closure, the flow path changing member changing a flow direction of the smoke screen;

the flow path changing member being substantially a cup shape and having a bottom portion and a circumferential wall;

the second closure having a shape such that a continuous second discharge flow path is formed between the second closure and the bottom portion of the flow path changing member, between the second closure and an inner circumferential surface of the circumferential wall of the flow path changing member, between the second closure and an annular end surface of an opening of the flow path changing member, and between the second closure and an outer circumferential surface of the circumferential wall of the flow path changing member;

the first discharge flow path, which is provided in the second closure, being extended in a direction coaxial with the cylindrical housing;

the second discharge flow path being provided between the second closure and the flow path changing member and being in communication with the first discharge flow path, extended in an orthogonal direction to the first discharge flow path and further bent at a plurality of locations, and an outlet of the second discharge flow path being a final discharge port;

the first closure having a discharge hole for discharging an ignition product which is generated at the time of actuation of the igniter;

a porous cylindrical body being arranged between a surface of the first closure where the discharge hole for the ignition product is not provided and the first discharge flow path of the second closure, the porous body having a circumferential surface extending in a longitudinal direction and the circumferential surface defining a plurality of openings;

a space between an inner circumferential wall surface of the cylindrical housing and the porous cylindrical body being a smoke screen generating agent-accommodating chamber which accommodates the smoke screen generating agent, and the discharge hole for the ignition product facing the smoke screen generating agent-accommodating chamber; and at the time of actuation of the igniter, the smoke screen generating agent in the smoke screen generating agent-accommodating chamber being ignited and burned to generate a smoke screen source, the smoke screen source passing through the plurality of openings and moving through an inside of the porous cylindrical body, passing through the first discharge flow path, the first discharge port and the second discharge flow path, and thereafter being discharged from the final discharge port to the outside in order to generate a smoke screen, wherein the second discharge flow path is provided between the second closure and the flow path changing member, and in communication with an outlet of the first discharge flow path, a through hole, which penetrates the flow path changing member in a thickness direction and reaches the second discharge flow path, is provided, an outlet of the second discharge flow path defined by a circumferential surface of the second closure and a circumferential surface of the flow path changing member is a first final discharge port and the through hole is a second final discharge port, and the first final discharge port and the second final discharge port are opened and closed to control a discharge direction of a smoke screen source.

4. The smoke screen generator according to claim 1, wherein the porous cylindrical body is a net molded into a cylindrical shape.

5. The smoke screen generator according to claim 1, wherein a central portion of the first closure, where the discharge holes of the ignition product are not provided, has a protruding portion, a surface of the second closure at a position, which faces the protruding portion of the first closure in the axial direction, has a first discharge flow path, and one end opening of the porous cylindrical body is fitted onto an outer side of the protruding portion of the first closure and the other end opening thereof is fitted to an inner side of the first discharge flow path of the second closure to fix the porous cylindrical body.

* * * * *